United States Patent [19]

Bozoglou

[11] Patent Number: 4,909,165

[45] Date of Patent: Mar. 20, 1990

[54] SEWING MACHINE FOR SEWING A RUBBER STRIP

[75] Inventor: Pantelis Bozoglou, Olching, Fed. Rep. of Germany

[73] Assignee: Juki Corporation, Tokyo, Japan

[21] Appl. No.: 194,994

[22] PCT Filed: Aug. 25, 1987

[86] PCT No.: PCT/EP87/00480

§ 371 Date: May 31, 1988

§ 102(e) Date: May 31, 1988

[87] PCT Pub. No.: WO88/01660

PCT Pub. Date: Mar. 10, 1988

[30] Foreign Application Priority Data

Aug. 25, 1986 [DE] Fed. Rep. of Germany ..... 3628829

[51] Int. Cl.[4] ..... D05B 35/06

[52] U.S. Cl. ..... 112/121.26; 112/121.27; 112/130; 112/152; 112/235

[58] Field of Search ..... 112/121.27, 130, 152, 112/235, 63, 50, 121.26

[56] References Cited

U.S. PATENT DOCUMENTS

| | | | |
|---|---|---|---|
| 3,094,089 | 6/1963 | Shuman | 112/235 |
| 3,149,589 | 9/1964 | Fowler, Sr. | 112/130 X |
| 3,468,269 | 9/1969 | Des Ormeaux et al. | 112/130 |
| 3,847,099 | 11/1974 | Braun | 112/152 |
| 3,972,296 | 8/1976 | Marforio | 112/121.27 |

*Primary Examiner*—Peter Nerbun

*Attorney, Agent, or Firm*—Tarolli, Sundheim & Covell

[57] ABSTRACT

Sewing machine for sewing a rubber strip to a tubular end piece of a garment made from an elastic textile material in order to produce an endless elastic band. The sewing machine comprises a presser foot (18) with an insertion opening (22) for the rubber strip (24), a braking device (48) to resist the insertion movement of the rubber strip and provided with two clamping elements (50, 52) which grip the strip, and a cutting system (26) which can be motor driven in order to cut the rubber strip. To eliminate the reintroduction process of the strip (24) into the insertion opening (22) of the presser foot (18) after said cutting, the cutting system (26) is arranged rear from the insertion opening (22) of and in the presser foot (18), and a drive (56) is associated with the braking device (48) to increase the gap between the two clamping element (50, 52) just before actuation of the cutting system (26).

5 Claims, 2 Drawing Sheets

SEWING MACHINE FOR SEWING A RUBBER STRIP

Figure 1:
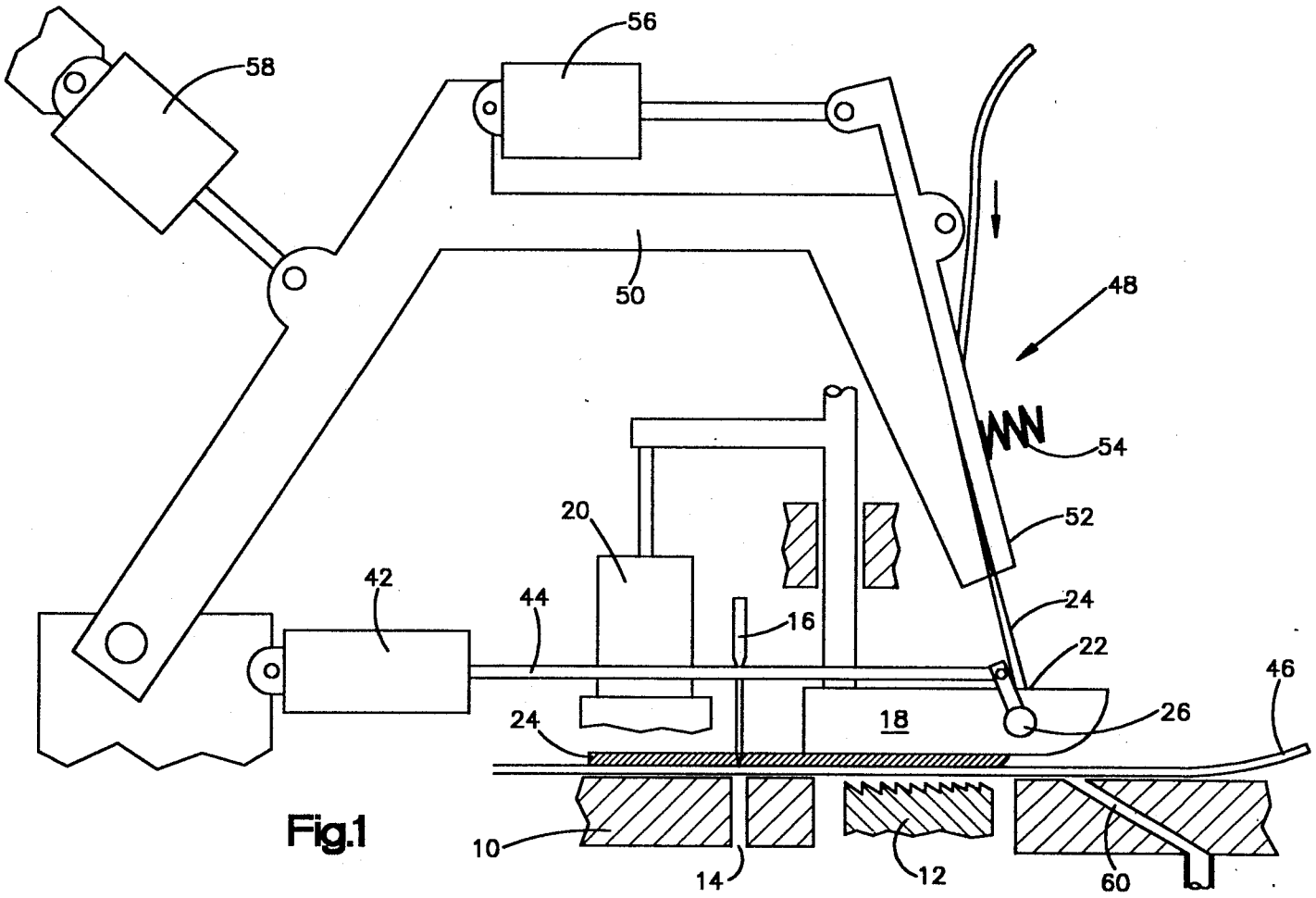

The present invention relates to a sewing machine for sewing a rubber strip to a garment.

German DE-OS No. 34 10 181 discloses a sewing machine in which a cutting system is used to cut a rubber strip arranged between a braking device and an insertion opening of the presser foot. This known sewing machine also has an additional braking device between the cutting system and the presser foot, and has a drive system thereof. The additional braking device is not actuated during insertion of the rubber strip, and is actuated immediately before actuation of the cutting system to hold the cut rear end of the rubber band under tension. After sewing the cut rear end of the rubber strip to the garment, it is necessary to insert the forward end of the rubber strip in the insertion opening of the presser foot. The forward end of the rubber strip is moved with the garment to the transporter. The condition that after forming each endless elastic band of the rubber strip, inserting the forward end into the insertion opening of the presser foot must be renewed, presents a very high work delay.

The object of the present invention is to improve the above-mentioned sewing machine, such that after cutting the rear end of each sewn rubber strip, the renewed insertion of the rubber band into the insertion opening of the presser foot is eliminated.

By the present invention, it is attained that after cutting the rear end of each sewn rubber strip, the forward end portion of the rubber strip coming from stock remains in the presser foot and therefore it is unnecessary to renew the insertion thereof.

Figure 2B:
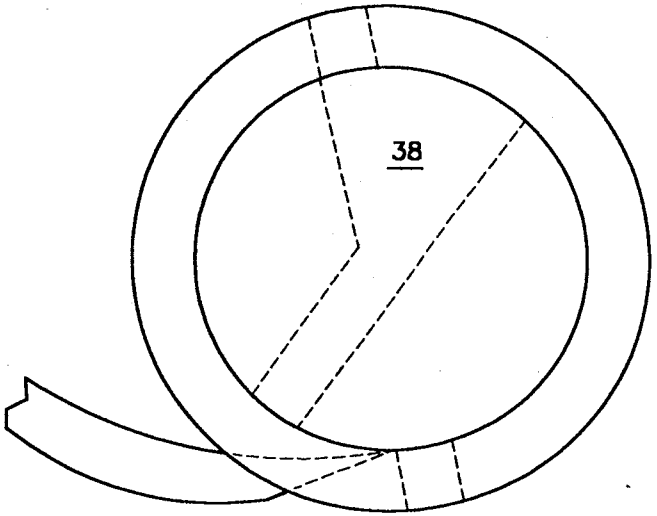
Figure 2A:
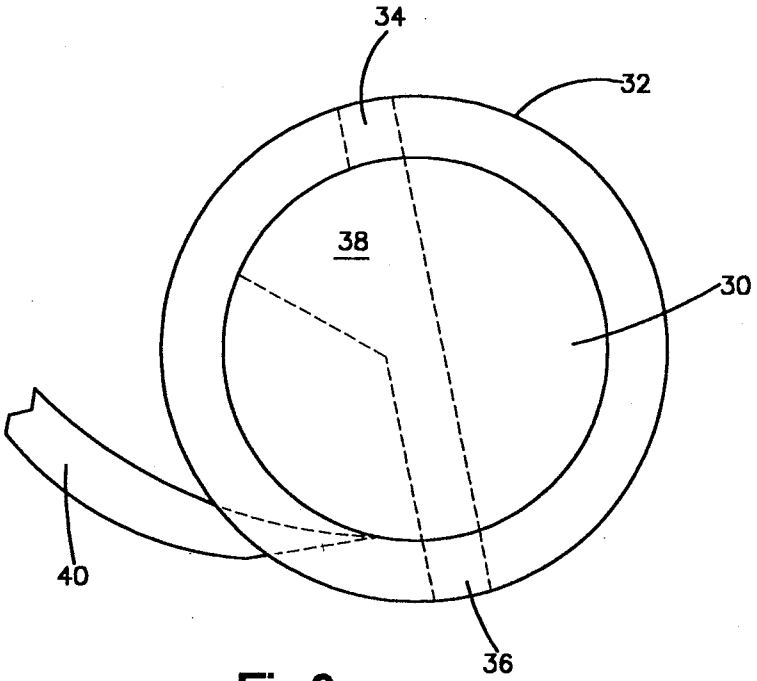

One embodiment of the present invention is shown in the drawings and will be described later. In the drawings:

FIG. 1 is a schematic illustration of essential parts of a sewing machine, according to the present invention; and FIGS. 2*a* and 2*b* are schematic illustrations of a cutting device to cut a rubber strip.

FIG. 1 shows a schematically shown side view of a sewing machine which is especially suited to sew a rubber strip to a tubular end piece of a garment made from an elastic textile material to produce an endless elastic band. As an under-support for sewing material, a base plate 10 is rigidly secured with the frame of the sewing machine. In an opening of the base plate 10, a transporter 12 to feed the sewing material is movably supported as known. The base plate 10 has also an opening 14 to receive a sewing needle 16. The electric drive for the transporter 12 and the sewing needle is known, and is not shown in the drawing for sake of clarity. A presser foot 18 is in the frame of the sewing machine upward and downward movably supported perpendicular to the base plate 10. A pneumatic cylinder 20 drives the presser foot 18, and is secured with the frame of the sewing machine and the piston rod thereof is connected with the presser foot 18. A forward portion of the pressure foot 18 has an insertion opening 22 for an elastic strip, that is, a rubber strip, 24 for an elastic strip which is supplied from a stock (not shown). In the presser foot 18, a cutting system 26 to cut the rubber strip is mounted, and the construction thereof will be described later.

As shown especially in FIGS. 2*a* and 2*b*, the cutting system 26 comprises a cylinder 30 which is rotatably supported in a case 32. The case 32 is non-rotatably secured in the presser foot 18, and has diametrically opposed slits 34 and 36 which align with an inlet opening 22 and with an outlet opening of the presser foot 18 respectively. When the presser foot 18 has no outlet opening, the slit 36 of the case 32 acts as the outlet opening. The cylinder 30 has a through passage 38, and the wall of inlet side is funnellike tapered. Clearly, the outlet side of the passage 38 aligns only at a predetermined angle position of the cylinder with the outlet slit 36 of the case 32, whereas the inlet side of the passage aligns with the inlet slit 34 of the case 32 over a large angle range of the cylinder 30 by the conical widening. In the presser foot 18, a cutting knife 40 is mounted, and the cutting edge thereof is near the outlet slit 36 of the case 32. To rotate the cylinder 30 relative to the case 32, a pneumatic cylinder 42 is supported to the frame of the machine, and a piston rod 44 thereof is pivotably connected with the cylinder 30 by radially extending arm. The length of the piston rod 44 is determined that the up and down movement of the presser foot 18 results in no remarkable rotation of the cylinder 30.

Thus, the rubber strip 24 supplied from a stock, not shown, is sewn by the sewing needle 16 between the presser foot 18 and the transporter 12 with supplied garment textile material 46, and it is necessary that the rubber strip 24 must be supplied in stretched state. To the purpose, at suitable distance over the presser foot 18, a brake 48 is mounted. The braking device 48 has two clamping elements 50 and 52 between which the rubber strip 24 is clamped. The clamping element 52 which has an opening to receive the rubber strip 24 is formed as double arms link and is pivotably connected with the clamping element 50. The clamping element 52 is urged to the clamping element 50 by a compression spring 54. The preload force of the compression spring 54 is regulated to adapt requirement to applied brake force by both clamping elements 50 and 52 to the rubber strip 24 and also the tension of the rubber strip 24. The free end of the clamping element 52 spaced from the presser foot 18 is pivotably connected to a piston rod of a pneumatic cylinder 56 which in turn is connected to the clamping element 50. By retracting the piston rod into the pneumatic cylinder 56, the movable clamping element 52 rotates against the force of the compression spring 54 so that the force is relieved.

As shown in FIG. 1, the clamping element 50 is rotatably connected to the frame of the machine in the direction of feeding the textile material 46, rearward from the presser foot 18 and approximately to the height. By the connection of the clamping element 50, the free end of the clamping element 50 moves substantially to the direction of the inlet opening 22 of the presser foot 18 when the element rotates. To rotate the clamping element 50, a pneumatic cylinder 58 mounted to the frame of the machine and the piston rod thereof is pivotably connected with the clamping element 50 spaced from the rotating point.

A compressed air nozzle 60 is arranged in the base plate 10 to direct air toward the forward end of the presser foot 18, and is suitably arranged adjacent to the lower side of the presser foot. The compressed air discharged from the nozzle 60 ends at the forward end of the rubber strip 24 projected from the lifted presser foot 18 rearward to the transporter 12. In piping connecting the compressed air nozzle 60 with a compressed air source, a magnetic valve, not shown, is inserted, such that the air path is opened only when the presser foot is in lifted position. Of course, it is not necessary to arrange the compressed air nozzle 60 as shown, it may be arranged otherwise to bend the free end of the rubber strip by the compressed air stream rearward along the under side of the presser foot.

The pneumatic cylinders 20, 42, 56 and 58 are connected through piping, not shown, with a compressed air source. In each piping, a magnetic valve is inserted to control by foot switch operated by an operator. By corresponding operation of the foot switches, magnetic valves for the pneumatic cylinders 20 and 58 are simultaneously opened and closed. The arrangement is provided thereby such that the pressure variation in the pneumatic cylinders 42 and 58 relative to the pneumatic cylinders 56 and 20 have predetermined delay. This can be done simply that the piping to the pneumatic cylinders 42 and 58 insert throttle.

The operation of the above-described sewing machine will be described.

At first, it is assumed that the presser foot 18 is in lift position, the engaged braking device 48 is in lower position, and the cutting system 26 is in non-operating position, and that a free end of the rubber strip 24 is projected from the lower side of the presser foot 18. As the presser foot 18 is in lift position, the compressed air nozzle 60 is connected with compressed air source, so that the free end of the rubber strip 24 projected from the presser foot 18 turns rearward along the underside of the presser foot 18. By corresponding operation of the foot switch, the pneumatic cylinder 20 is supplied with compressed air to lower the presser foot 18, so that the presser foot presses and holds the rubber strip 24 on the textile 46 which is on the base plate 10. The operation of the foot pedal results that the pneumatic cylinder 58 is supplied by compressed air at the same time, with a predetermined delay, so that the braking device 48 pivots upwards as a whole from the presser foot 18, and the end portion of the rubber strip 24 is tensioned. While the position of the presser foot 18 and the braking device 48 is maintained, suitable operation of foot switch actuates the drive for the transporter 12 and the sewing needle 16, so that the stretched state rubber strip 24 is sewn with the textile 46 successively. Meanwhile the braking device 48 presses, i.e. the movable clamping element 52 is urged to the clamping element 50 by the force of the compression spring 54 so supply braking force to the rubber strip 24 which is fed in stretched state. Then, from the textile material 46, tubular end portion of a garment, e.g. leg portion of a bath suit, having elastic band can be formed by the above-mentioned way. Shortly before the sewing rubber strip to the textile material overlap the forward end thereof, which occurs at the forward end of the presser foot 18, by suitable operation of foot switch, the pneumatic cylinder 56 actuates by compressed air to release the braking device 48, so that the forward end portion of the supplied rubber strip 24 is tensionless. The operation of the foot switch results that the pneumatic cylinder 42 is supplied by compressed air at the same time, with certain delay, so that the cylinder 30 rotates relative to the case 32 of the cutting system 26 from the position shown in FIG. 2*a* to FIG. 2*b*. Then, the rubber strip in the passage 38 of the cylinder 30 is pressed to the edge of the cutting knife 40 and is separated. The tensionless rear end portion of the rubber strip 24 will be sewn with the garment 46, so that it will sewn overlapping the forward end portion which had sewn in stretched state. As the distance between the cutting knife 40 and the sewing needle 16, in practice under 20 mm, the overlapping is very short and material saving can be attained. The sewing process is end, and an endless elastic band is formed in the garment. By suitable operation of foot switch, drive of the transporter 12 and the sewing needle 16 is stopped, and the cutting system 26 inoperative, and the braking system 48 returns to operative position. Then, by suitable operation of foot switch, the pneumatic cylinders 20 and 58 is supplied with compressed air, so that the presser foot 18 raises, and the whole braking system 48 pivots downward with predetermined delay. The result is such that the forward end portion of the rubber strip 24 which was in the presser foot 18 projects from the presser foot and by influence of now injected compressed air from the nozzle 60, moves rearward along the lower side of the presser foot. Now the sewing machine is ready to start new sewing process to form an endless elastic band.

Apart from the shown embodiment, the pneumatic cylinder which serves to operate the cutting system may be secured with a presser foot supporting pivot arm. The pneumatic cylinder in this case has no effect to the cutting system by operation of the pivot arm and the presser foot.

Such embodiment has constructional advantage compared with the shown embodiment, such that forward and both sides of the presser foot are kept free. Then, the operator can perform sewing process optically without disturbance, and the material can be introduced by fingers directly. Thus, very precise sewing of the rubber strip along the material edge can be performed.

I claim:

1. Sewing machine for sewing an elastic strip to a garment made from a sewing material, said sewing machine comprising a sewing needle, a presser foot for pressing the sewing material to a base plate and having an insertion opening for the elastic strip and movable up and down by motor drive relative to the base plate, a transporter mounted in the base plate to transport the sewing material, a guide device to guide the elastic strip to the presser foot, a braking device to resist guide movement of the elastic strip and provided with two clamping elements which grip the elastic strip, and a motor driven cutting system to cut the elastic strip and mounted between the braking device and the sewing needle, characterized in that the cutting system (26) is arranged between the insertion opening (22) in the presser foot (18) and the sewing needle, and that the braking device (48) has a drive (56) in order to increase the gap between the two clamping elements (50, 52 immediately before actuation of the cutting system (26).

2. Sewing machine according to claim 1, in which the cutting system (26) consists of a cylinder (30) rotatably journalled in the presser foot (18) and having a diagonal guide slit (38), a cutting knife (40) fixed to the presser foot (18), and a drive (42) for rotation of the cylinder (30).

3. Sewing machine according to claim 1 or 2, in which a compressed air nozzle (60) is mounted to direct air in the feeding direction of the elastic strip (24) along the under side of the presser foot (18).

4. A sewing machine for sewing an elastic strip to a piece of material, said sewing machine comprising presser foot means for pressing a portion of the elastic strip against the piece of material, said presser foot means including means for defining an insertion opening through which the elastic strip extends, gripper means for gripping a portion of the elastic strip before the gripped portion of the elastic strip enters the insertion opening to enable the elastic strip to be tensioned and stretched, needle means for sewing the stretched elastic strip to the piece of material while said presser foot presses the stretched elastic strip against the piece of material and while said gripper means grips the elastic strip, said gripper means being operable to release the elastic strip to eliminate tension in the elastic strip after a portion of the elastic strip has been sewn to the piece of material, cutter means for cutting the tensionless elastic strip after the elastic strip has been sewn to the piece of material, said cutter means being operable to cut the tensionless elastic strip at a location between the insertion opening in said presser foot and said needle means so that a portion of the elastic strip extends through the insertion opening in said presser foot after the elastic strip has been cut by said cutter means.

5. A sewing machine as set forth in claim 4 further including means for moving said gripper means away from said presser foot to stretch the elastic strip.

* * * * *